US005385599A

United States Patent [19]

Freissmuth

[11] Patent Number: 5,385,599

[45] Date of Patent: Jan. 31, 1995

[54] AGENT FOR DESULFURIZATION, DEPHOSPHORIZATION, DESILICONIZING AND DENITRIDING OF PIG IRON, CAST IRON AND CHROMIUM AND MANGANESE CONTAINING MELTS AND PROCESS FOR THE TREATMENT THEREOF

[76] Inventor: Alfred Freissmuth, Alpenblick 7, D-83355 Grabenstatt-Bergen, Germany

[21] Appl. No.: 166,639

[22] Filed: Dec. 14, 1993

[30] Foreign Application Priority Data

Dec. 15, 1992 [DE] Germany ..... 4242328

[51] Int. Cl.[6] ..... C21C 7/02

[52] U.S. Cl. ..... 75/326; 75/312; 75/318; 75/322; 75/326

[58] Field of Search ..... 75/312, 318, 322, 326

[56] References Cited

U.S. PATENT DOCUMENTS

| | | | |
|---|---|---|---|
| 3,258,327 | 6/1966 | Smoot | 75/326 |
| 4,147,539 | 4/1979 | Kekish | 75/326 |
| 4,358,312 | 11/1982 | Braun | 75/312 |
| 4,988,387 | 1/1991 | Schrodter | 75/312 |

*Primary Examiner*—Peter D. Rosenberg

*Attorney, Agent, or Firm*—Kenneth P. Glynn; Diane L. Ferrone; Gina Gualtieri

[57] ABSTRACT

An agent for desulfurization, dephosphorization, desiliconizing, and denitriding of ironmelt and melt containing chromium or manganese, consisting of at least one of the following mineral raw-material: alkali-containing plagioclase (feldspar), alkali-containing orthoclase, montmorillonite (perlite), bentonite, muscovite, or zeolithe, and calcium carbide and/or calcium oxide.

These mixtures can be blended further with scale, Fe-ores, Cr-ores or Mn-ores and used by standard technologies. The mineralic components, in connection with calcium carbide, lime, iron-ore or scale or other related ores, cause an effective reduction of unwanted elements, such as sulfur, phosphorus, silicium, and nitrogen, in the metal melts.

The slags produced are freely skimmed and contain less iron granules than standard agents. Some of these materials may be enriched with alkali oxides by sintering or melting with appropriate compounds, like soda ash.

This invention also involves a process for the treatment of iron-, ferrochromium and ferromanganese melts, wherein the components of the agent are fed either pre-mixed or separately into the melt.

20 Claims, 1 Drawing Sheet

AGENT FOR DESULFURIZATION, DEPHOSPHORIZATION, DESILICONIZING AND DENITRIDING OF PIG IRON, CAST IRON AND CHROMIUM AND MANGANESE CONTAINING MELTS AND PROCESS FOR THE TREATMENT THEREOF

BACKGROUND OF THE INVENTION

1. Field of the Invention

The present invention is directed to an agent for desulfurization, dephosphorization, desiliconizing and denitriding of pig-iron, cast iron and similar melts and a process for the treatment thereof.

2. Information Disclosure Statement

In recent decades, many proposals for the desulfurization and dephosphorization of iron melts, chromium and manganese melts have been described in the literature. From these agents, those based on calcium carbide, containing gas-evolving additives, gained wide acceptance. Agents in DE-PS 17 58 520 permit—by employing corresponding technologies—describe the treatment of large volumes of iron in which calcium carbonate is used as a gas-evolving additive. In German application DE PS 22 52 795, hydrated lime is proposed as a gas evolving component. EP-A 0 138 417 describes a mixture composed of burnt lime, lime-stone-carbon and fluospar. These agents exhibit—due to their extremely fine grain size—poor flow performance and can only be fed with pneumatic systems with difficulties. The general use of these so far known agents is limited by the fact that they cause large slag volumes and considerable iron losses which can reach up to 70% of the total slag weight.

These additives have to be considered as inactive with respect to metallurgical reactions; the purpose of this burden-material is to improve the dilution of the basic component—in addition to gas release—the pneumatic feeding. In general, fluid agents are added to improve the flow performance of the base material as described in EPO 0 226 994.

Some of these dilutants release gas which is supposed to improve the mixing of the desulfurizer with the liquid melt. The residue of these components —regardless of whether lime-hydrate or lime-stone is used—is lime, at the temperatures of the melt present in the solid state. Because diffusion controls the desulfurization with solid phases, this process is governed decisively by the residence time of the active particle. The lime particle developed from the dilutants contributes only a limited extent to the reaction with the melt; therefore, it can be considered as passive with respect to the metallurgical reactions.

The slags resulting from mixtures consisting of calcium carbide, lime-stone and fluid aids tend to form a crust. The solidified slag is difficult to remove. Mechanical equipment is necessary to remove this crust. Very often it is necessary to apply fluospar or soda ash after treatment to fluidize this accumulation.

Another effect of these gas evolving additives is consumption of a part of the calcium carbide for reaction with the $CO_2$ and $[OH]^-$ respectively. In DE-PS 22 52 796, additives are described which release hydrogen or nitrogen. The effect of these gases is neutralized to a great extent by the carrier gas. However, the more important problem of solid-liquid-reaction, dominating with calcium carbide, is not solved.

Fluospar was also proposed to liquify the slag, but fluospar causes environmental problems and a metallurgical potential cannot be contributed to this mineral.

Desulfurizing by means of an impeller produces deposits on the side walls of the ladle. As these crusts also contain calcium carbide, it is eliminated from the desulfurizing process. Further the impeller may be destroyed.

Another proposal recommends using a calcium carbide according to a eutectic composition containing some 65–67 w.-% $CaC_2$ chemically, with the remainder mainly CaO. However, this composition did not change the slag structure which also contained up to 70% by weight of iron granules.

In general it is not possible to make use of the best working conditions, for instance, the lowest lance position or the correct immersion depth for the impeller. These operational factors can reduce the efficiency of the agent considerably. Therefore, there is a permanent demand for a desulfurizing agent which overcomes these shortcomings.

The addition of aluminum metal to the metal melt, in contents up to 0.04% may improve the efficiency of the desulfurizer, but does not eliminate the difficulties with the dry slag, caused by calcium carbide and also by lime.

Another negative effect associated with the use of dry desulfurizing agents such as calcium carbide, is the so-called incubation time, the time during the first 20 to 30% of the whole treatment time in which the desulfurizing reaction is very slow, until the slag is heated to the approximate temperature of the melt.

The additives used so far to blend with the basic desulfurizer have had little or no effect on the inherent problems of a solid-liquid reaction. Moreover these additives contributed only a very limited extent to the reduction and overcoming of operational deficiencies of the desulfurizing process used.

SUMMARY OF THE INVENTION

This invention is directed to an agent for desulfurization, dephosphorization, desiliconizing, and denitriding of iron melt and melt containing chromium or manganese, consisting of at least one of the following mineral raw-materials: alkali-containing plagioclase (feldspar), alkali-containing orthoclase, montmorillonite (perlite), bentonite, muscovite, or zeolithe, and calcium carbide and/or calcium oxide.

These mixtures can be blended further with scale, Fe-ores, Cr-ores or Mn-ores and used by standard technologies. The mineral components, in connection with calcium carbide, lime, iron-ore or scale or other related ores, cause an effective reduction of unwanted elements, such as sulfur, phosphorus, silicium, and nitrogen, in the metal melts.

The slags produced are freely skimmed and contain less iron granules than standard agents. Some of these materials may be enriched with alkali oxides by sintering or melting with appropriate compounds, like soda ash.

This invention also involves a process for the treatment of iron-, ferrochromium and ferromanganese melts, wherein the components of the agent are fed either pre-mixed or separately into the melt.

DETAILED DESCRIPTION OF THE INVENTION

Figure 1:
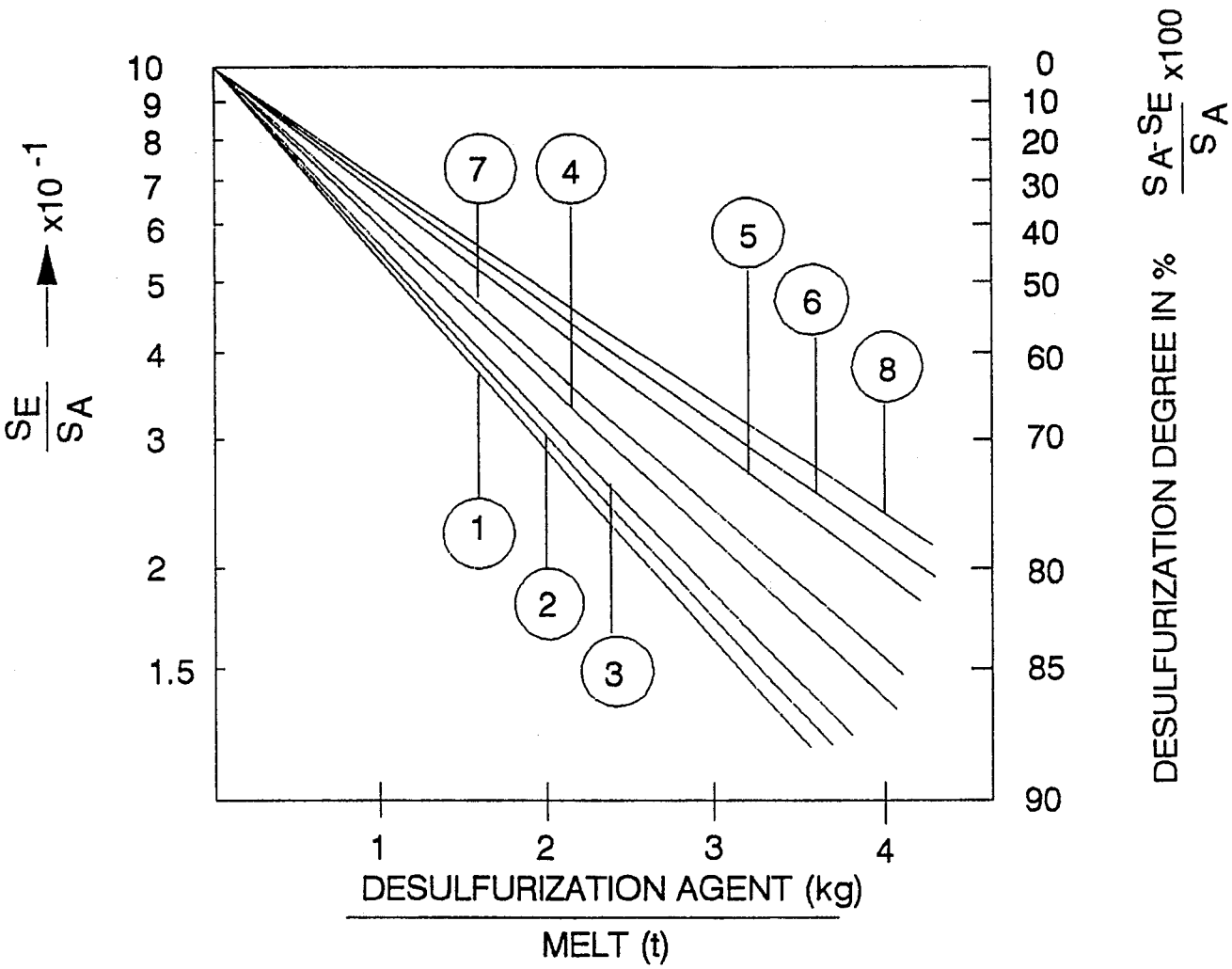
FIG. 1 shows, in graph form, desulfurization results with different mixtures of the present invention.

The aim of this invention is, therefore, to find an agent for desulfurization, dephosphorization, desiliconizing and denitriding of pig-iron, cast iron and similar metal melts like ferro-chromium and ferro-manganese melts which maintains the advantages of calcium carbide and lime, is able to reduce the disadvantages of solid-liquid reactions, and eliminates the negative influences of the operational variables by suitable additives. This task is solved according to this invention by an agent containing at least one of the following mineral-raw material:

alkali containing plagioclase, e.g. Na-feldspar (albit),
alkali containing orthoclase, e.g. K-feldspar, nepheline-syenite,
montmorillonite, e.g. perlite,
bentonite, preferably Na-rich minerals,
vermiculite,
zeolithe,
muscovite,
and 10–90 w.-% of calcium carbide, calcium oxide, or a mixture of both.

These mineral raw materials exhibit the following essential features, important for the overall reactions:

at temperatures of the melts to be treated, these mineral raw materials are fully liquefied; during heating and holding at these temperatures, they precipitate gaseous compounds, thus, strongly promoting the mixing of the agent with the melts. Some develop sodium and potassium and some vaporize crystal water. The compounds sodium and potassium improve the capacity of the slag to accept and hold removed elements like sulfur or phosphorous.

Minerals like montmorillonite/perlite develop a foaming constitution which exists only for a very short time, thus improving the mixing and splitting of gas bubbles.

These mineral raw materials are abundant and relatively cheap. The preparation and handling requires no special care, and they do not cause any ecological risk. In certain cases it may be advisable to change their composition by sintering or melting with other materials like soda ash and others. The content of alkali oxide in Na feldspar may be increased by melting together with soda ash up to 50 w.-%; advantageously, the sodium oxide content will be rised up to 30 w.-%.

The agent according to this invention contains 10–90 w.-% calcium carbide or lime; a content of calcium carbide between 30–60 w.-% is preferred. The calcium carbide may have a eutectic or standard composition. A lime content in this agent, preferably 10–30 w.-% is advantageous.

Further, it became apparent that agents according to this invention can be used for dephosphorization desiliconizing and denitriding, besides the application as a desulfurizing agent. For these purposes, the agent contains in addition another additive like iron oxide, iron ore, scale, chromium ore and manganese ore or similar, supplemented by lime and/or an alumina containing mineral as a slag forming material, preferably, the content of these oxides ranges from 10–60 w.-% whereas the oxide content of 30–50 w.-% yielded the best results.

It was found that an addition of 5–50 w.-% of one of the minerals zeolithe, bentonite, or vermiculite, remainder calcium carbide or lime, or a mixture thereof, improves the efficiency of the reaction. The consistency of the agent according to this invention exhibits more or less the same grain size whereas for the injection technology a grain size of less than 0.5 mm; for the impeller-shaking ladle process less than 2 mm is recommended. For the addition of these agents into the ladle, the grain size may be increased to 5 mm.

Besides the advantages achieved with blends according to this invention, another advantage results form the fact that in the grinding of these components the extra fine grain size is not necessary as the additives are liquified at the treatment temperatures of the melts. This eliminates the generally experienced problems when feeding by pneumatic or mechanic systems. Special fluid aids are normally not necessary for these agents according to this invention. Further, the extremely fine grain size of calcium carbide or lime necessary for the traditional agents can be avoided. Consequently, the often experienced pulsating feeding is widely reduced or eliminated respectively, a handicap of the traditional agents. Splashing is consequently reduced.

According to the technology the grain size on the component may be altered according to the technology employed.

As illustrative of the invention, the following examples are given:

with impeller-desulfurizing plants employed in ladles containing 1.5 and 6 tons of cast iron an agent consisting of 75–95 w.-% techn. calcium carbide and 5–25 w.-% of Na-feldspar or perlite was tested. A mixture containing 20% Na-feldspar gave the following results: the crust formation was considerably reduced, the quantity added was reduced from 1.3 to 1.7% standard carbide of the metal weight down to 1.0% of the new agent; with starting sulfur of 0.09 to 0.145 w.-% S could be reduced down to 0.001 w.-%. The impeller life was increased by 30 or 50%. The carbide residue in the slag was considerably smaller compared with standard carbide alone. Operational variables did not exert any negative influence on the results at all.

In shaking ladles containing 10–17 tons of pig iron standard calcium carbide was replaced by a mixture of 85 w.-% of carbide and 15 w.-% of albite or perlite, respectively; grain size 0.2 to 1.0 mm. The consumption figures were reduced by 15 to 20% to achieve the same results as with standard carbide. The deviation range of the final sulfur was distinctly smaller; the skimming of the slag was easy and contained comparatively little carbide.

In another test series with an impeller system, FeCr- and FeMn-melts with about 17t were treated. The carbide mixture contained 15 w.-% albit or perlite respectively and 15 w.-% kaolinite.

The desulfurization efficiency with the agent according to this invention was improved from 50–70% to 85–93%, compared with standard practice with calcium carbide.

In a test series the efficiency of the new mixtures were tested during slag free tapping from an electric arc furnace (90t). A mixture of burnt lime, 10 w.-% kaolinite and 20 w.% albit was added. The desulfurization was improved by 20% to 40% depending on the tapping flow compared with standard practice using the same quantity of soft burnt lime.

Further, the efficiency of a mixture of burnt lime was tested in the tapping ladle comprising 30 w.% of an albit with increased content of $Na_2O$, total content 30%. A starting sulfur of 0.0180 w.-% was reduced 50–65%.

In a couple of test series the efficiency of the new mixtures were tested with the injection technology. These test were made as well in a premixed condition (mono-injection) as in the separate injection of the components (co-injection), where mixing happens in the lance.

The following mixtures (in weight-percent) were tested:

MIXTURE 1: 60% calcium carbide (techn)+20% lime, remainder albit

MIXTURE 2: 60% calcium carbide (eut)+20% albit+10% perlite+10% lime

MIXTURE 3: 60% calcium carbide (eut)+25% nepheline-syenite+15% lime

MIXTURE 4: 50% calcium carbide (tech)+30% lime +20% zeolithe

MIXTURE 5: 60% albit (enriched in the liquid phase up to approximately 30% Na20 in the final product)+20% Kaolinite+20% lime MIXTURE 6: 60% albit, enriched up to 30% Na20,+40% lime MIXTURE 7: 40% K-feldspar+10% lime+50% calcium carbide MIXTURE 8: 70% lime+20% albit+10% bentonite The tests were made in an open ladle with approximately 185 tons of pig-iron, and in a submarine ladle holding approximately 220 tons of pig-iron. The starting sulfur was in the range of 0.042 w.-% and the pig-iron temperature in the range of 1.350 to 1420 degrees C. The desulfurization results with these mixtures are shown schematically in FIG. 1.

A mixture of approximately 4.0 kg/t yielded a desulfurization of more than 93% for mixture 1 and more than 90% for mixture 2 and 3.

A reduction in calcium carbide, as in mixture 4 yields a desulfurization of more than 86%. Mixtures according to numbers 5, 6, and 8, containing lime only, instead of calcium carbide, yielded, for 4.0 kg/t a desulfurization of 75–80%. All of the results with mixtures with calcium carbide were compared with standard desulfurizers containing calcium carbide and calcium carbonate; the desulfurization rate was lower by 10–25% These standard mixtures demanded a carrier gas of 22 up to 70 NI/kg, showing a pulsating feeding; this resulted in heavy splashing with the slag containing up to 70% of iron granules. Racking was difficult and time consuming.

All mixtures according to this invention were easy to feed with the standard dispenser. The feed rate was freely varied between 40 and 100 kg/min. All mixtures produced a slag which was easily removable, either by tilting or, if necessary, mechanical racking. Crust formation was not observed. An albit, enriched up to 30% Na 0, showed a smooth reaction.

All mixtures containing these new additives exhibited no influence of the treatment temperature. The range in final sulfur was reduced, while standard mixtures showed variables of plus 0.006% and minus 0.001% of the aim sulfur.

The test in the submarine ladle, holding some 220 tons, yielded the same metallurgical results. Surprisingly, it was stated that agents according to this invention yielded a remarkable dephosphorization and desiliconizing and denitriding power, parallel to the desulfurization. Especially Na- or K-rich minerals like albit or K-feldspar, and also Na-bentonite, were very effective in connection with lime, iron-ore, chromium-ore/or Manganese-ore. Very favorable and surprising was the smooth reaction of Feldspar-minerals whose content in Na O or K O was increased up to 30–50 w.-%. The content of these minerals or the enriched grades were limited to 50 w.-%. Remainder scale or ores were selected according to the analysis requested. The reduction of nitrogen was basically linear with higher contents of the alkali oxides tending to exhibit a stronger effect. It was possible to reduce the N-content by 10–50%, in reference to the initial content.

To reduce the silicon content by 0.1 w.-% by injecting a mixture containing 40–60% scale, 30 w.-% albit, remainder lime was used in a quantity of 4–7kg/t. It was advantageous to grind the mixture down below 0.1 mm. All reactions were running parallel; at the same time a desulfurization reaction was also. achieved. These new mixtures were able to replace the highly reactive soda ash. It was helpful to use a carrier gas enriched in oxygen content, thus reducing the consumption figures by approximately 20%.

The smooth release of the alkalis does not produce bursting gas bubbles as with soda ash. This gradual release of the alkalis in the agents according to this invention avoids the instant removal of the components from the pig-iron-melt, thus increasing the residence and reaction time of the injected agent in the melt.

The agent according to this invention is preferably injected into the melt by a dipping lance. By the use of two or more feeding systems, the components of the agent can be combined and mixed in the lance.

To adjust the composition of the agent during the treatment of the melt, the components of the agent separately can be dosed and fed into the melt. Obviously, numerous modifications and variations of the present invention are possible in light of the above teachings. It is therefore understood that within the scope of the appended claims, the invention may be practiced otherwise than as specifically described herein.

What is claimed is:

1. An agent for desulfurization, dephosphorization, desiliconizing and denitriding of pig-iron, cast iron, FeCr- and FeMn- containing melts, comprising:

(a) 90% to 10% by weight of at least one of the mineral raw material components selected from the group consisting of alkali plagioclase, alkali orthoclase, montmorillonite, bentonite, vermiculite, muscovite and zeolithe; and, (b) 10% to 90% by weight of an additional compound chosen from the group consisting of calcium carbide, calcium oxide, and combinations thereof.

2. The agent of claim 1 further comprising 10% to 60% by weight of a mineral chosen from the group consisting of iron oxide as scale, iron ore, manganese ore and chromium ore.

3. The agent of claim 1 further including 5% to 50% by weight of an alumina containing mineral.

4. The agent of claim 2 further including 5% to 50% by weight of an alumina containing mineral.

5. The agent of claim 1 wherein said alkali plagioclase is Na-feldspar.

6. The agent of claim 1 wherein said alkali orthoclase is chosen from the group consisting of nepheline and nepheline syenite.

7. The agent of claim 1 containing at least 5% to 50% by weight of one of the minerals chosen from the group consisting of zeolithe, bentonite, vermiculite and muscovite; with the remainder comprised of a compound chosen from the group consisting of calcium carbide, calcium oxide and mixtures thereof.

8. The agent of claim 1 wherein each of said components exhibit a similar maximum grain size for injection processes up to a maximum of less than 1 mm.

9. The agent of claim 1 wherein each of said components exhibit a similar maximum grain size for impeller and shaking processes up to a maximum of less than 3.0 mm.

10. The agent of claim 1 wherein each of said components exhibit a similar maximum grain size for additions to tapping ladle or runner up to a maximum of less than 5.0 mm.

11. The agent of claim 1 wherein a content of alkali oxide is increased up to 50% by weight by sintering of the components chosen from the group consisting of alkali plagioclase and alkali orthoclase together an alkali rich compound.

12. The agent of claim 11 wherein said alkali rich compound is soda ash.

13. The agent of claim 12 wherein said alkali plagioclase is Na-feldspar.

14. The agent of claim 13 wherein a content of sodium oxide is increased to 30% by weight.

15. The agent of claim 1 wherein a content of alkali oxide is increased up to 50% by weight by melting of the components chosen from the group consisting of alkali plagioclase and alkali orthoclase together with alkali rich compounds.

16. The agent of claim 15 wherein said alkali rich compound is soda ash.

17. The agent of claim 16 wherein said alkali plagioclase is Na-feldspar.

18. The agent of claim 17 wherein a content of sodium oxide is increased to 30% by weight.

19. Process for the treatment of iron-, ferrochromium and ferromanganese melts comprising:

a) forming a treatment agent by combining 90% to 10% by weight of at least one of the mineral raw material components selected from the group consisting of alkali plagioclase, alkali orthoclase, montmorillonite, bentonite, vermiculite, muscovite and zeolithe with 10% to 90% by weight of an additional compound chosen from the group consisting of calcium carbide, calcium oxide, and combinations thereof and then, b) injecting said agent through a dipping lance into at least one of said melts.

20. Process for the treatment of iron-, ferrochromium and ferromanganese melts comprising:

(a) feeding through a dipping lance into at least one of said melts at least one of the mineral raw material components selected from the group consisting of alkali plagioclase, alkali orthoclase, montmorillonite, bentonite, vermiculite, muscovite and zeolithe; and, (b) separately feeding through a dipping lance into said at least one of said melts a compound chosen from the group consisting of calcium carbide, calcium oxide, and combinations thereof;

wherein the components of step (a) and the components of step (b) form a treatment agent, said treatment agent being made up of 90% to 10% by weight of the components of step (a) and 10% to 90% of the components of step (b).

* * * * *